US010415380B2

(12) United States Patent
Morgan et al.

(10) Patent No.: US 10,415,380 B2
(45) Date of Patent: Sep. 17, 2019

(54) SAMPLE TANK WITH INTEGRATED FLUID SEPARATION

(71) Applicant: BAKER HUGHES INCORPORATED, Houston, TX (US)

(72) Inventors: Christopher J. Morgan, Spring, TX (US); Francisco Galvan-Sanchez, Houston, TX (US); Hermanus J. Nieuwoudt, Tomball, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 14/043,423

(22) Filed: Oct. 1, 2013

(65) Prior Publication Data

US 2015/0090447 A1 Apr. 2, 2015

(51) Int. Cl.
*E21B 49/08* (2006.01)

(52) U.S. Cl.
CPC ..... *E21B 49/081* (2013.01)

(58) Field of Classification Search
CPC ..... E21B 49/081
See application file for complete search history.

(56) References Cited

U.S. PATENT DOCUMENTS 2,344,365 A * 3/1944 Phillips ..... B27M 3/22 142/1
2,705,418 A * 4/1955 Francis ..... G01N 15/0826 73/38
3,530,711 A 9/1970 Jean-Louis
(Continued)

FOREIGN PATENT DOCUMENTS

GB 2344365 * 6/2000 ..... E21B 49/08
GB 2407109 A 4/2005
(Continued)

OTHER PUBLICATIONS

"Determining the Origin of Hydrocarbon Gas Shows and Gas Seeps (Bacterial Gas vs. Thermogenic Gas) Using Gas Geochemistry", Weatherford Laboratories (2011), available at http://www.gaschem.com/determ.html (last accessed Jul. 23, 2015).*
(Continued)

*Primary Examiner* — Zakiya W Bates
*Assistant Examiner* — Crystal J Miller
(74) *Attorney, Agent, or Firm* — Mossman, Kumar & Tyler, PC

(57) ABSTRACT

A method for obtaining a fluid sample downhole that has at least a target fluid and an undesirable fluid may include receiving the fluid sample into a sample tank positioned that has a main chamber and isolating at least a portion of the undesirable fluid from the target fluid in the main chamber. A related apparatus may include a conveyance device configured to be conveyed along a borehole and a fluid sampling tool positioned along the conveyance device. The conveyance device may include a probe receiving the fluid sample from a formation; a pump drawing the fluid sample through the probe; and at least one sample tank receiving the fluid sample from the pump. The sample tank may include a main chamber receiving the fluid sample and an isolation volume isolating at least a portion of the undesirable fluid from the target fluid in the main chamber.

9 Claims, 3 Drawing Sheets

(56) References Cited

U.S. PATENT DOCUMENTS

| | | | | |
|---|---|---|---|---|
| 5,303,775 | A * | 4/1994 | Michaels | E21B 49/10 166/264 |
| 6,659,177 | B2 * | 12/2003 | Bolze | E21B 49/082 166/167 |
| 7,878,244 | B2 * | 2/2011 | Nold, III | E21B 49/10 166/100 |
| 2002/0084072 | A1 * | 7/2002 | Bolze | E21B 49/082 166/264 |
| 2002/0129936 | A1 * | 9/2002 | Cernosek | E21B 49/082 166/264 |
| 2004/0129070 | A1 | 7/2004 | Bolze et al. | |
| 2004/0244971 | A1 * | 12/2004 | Shammai | E21B 49/081 166/250.1 |
| 2005/0028973 | A1 | 2/2005 | Paluch et al. | |
| 2005/0082059 | A1 * | 4/2005 | Nogueira | E21B 49/081 166/264 |
| 2006/0137479 | A1 * | 6/2006 | Gilbert | E21B 49/081 73/864.16 |
| 2008/0066538 | A1 * | 3/2008 | Kamiya | E21B 43/38 73/152.28 |
| 2010/0089569 | A1 * | 4/2010 | van Zuilekom et al. | 166/250.01 |
| 2010/0175873 | A1 | 7/2010 | Milkovisch et al. | |
| 2011/0073306 | A1 | 3/2011 | Morrison | |

FOREIGN PATENT DOCUMENTS

| | | | |
|---|---|---|---|
| WO | 2005089399 | A2 | 9/2005 |
| WO | 2006044567 | A2 | 4/2006 |
| WO | 2008115178 | A1 | 9/2008 |

OTHER PUBLICATIONS

PCT/US2014/058077—International Search Report dated Jan. 28, 2015.

EP Application No. 14850883.1 Search Report dated Mar. 6, 2017.

* cited by examiner

SAMPLE TANK WITH INTEGRATED FLUID SEPARATION

FIELD OF THE DISCLOSURE

This disclosure pertains generally to investigations of underground formations and more particularly to devices and methods for sampling fluids in a borehole.

BACKGROUND OF THE DISCLOSURE

Commercial development of hydrocarbon producing fields requires significant amounts of capital. Before field development begins, operators desire to have as much data as possible in order to evaluate the reservoir for commercial viability. Therefore, numerous tests are performed during and after drilling of a well in order to obtain data regarding the nature and quality of the formation fluids residing in subsurface formations. As is known, the quality of the samples obtained during these tests heavily influences the accuracy and usefulness of the test results.

In one aspect, the present disclosure addresses the need to obtain pristine fluid samples from a subsurface information.

SUMMARY OF THE DISCLOSURE

In aspects, the present disclosure provides a method for obtaining a fluid sample downhole. The fluid sample may include at least a target fluid and an undesirable fluid. The method may include receiving the fluid sample into a sample tank that has a main chamber and isolating at least a portion of the undesirable fluid from the target fluid in the main chamber.

In aspects, the present disclosure provides an apparatus for obtaining a fluid sample downhole. The fluid sample may include at least a target fluid and an undesirable fluid. The apparatus may include a conveyance device configured to be conveyed along a borehole; and a fluid sampling tool positioned along the conveyance device. The conveyance device may include a probe receiving the fluid sample from a formation; a pump drawing the fluid sample through the probe; and at least one sample tank receiving the fluid sample from the pump. The sample tank may include a main chamber receiving the fluid sample and an isolation volume isolating at least a portion of the undesirable fluid from the target fluid in the main chamber.

Examples of certain features of the disclosure have been summarized rather broadly in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

In aspects, the present disclosure relates to devices and methods for obtaining fluid samples. In some instances, a fluid sample may include two immiscible fluids: a target fluid and relatively denser undesirable fluid. In such instances, some or all of the undesirable fluid may be separated and isolated in an isolation volume. This may be beneficial when sampling gases and gas condensates. In one non-limiting embodiment, a sample chamber includes a piston that has a small receiving isolation volume. The receiving isolation volume may be isolated using a suitable uni-directional flow control device. The flow control device opens to allow the undesirable fluid to enter the receiving volume during the filling of the sample chamber or over-pressuring of the fluid sample in the sample chamber. The present teachings may be advantageously applied to a variety of systems both in the oil and gas industry and elsewhere. Merely for brevity, certain non-limiting embodiments will be discussed in the context of tools configured for borehole uses.

Figure 1:
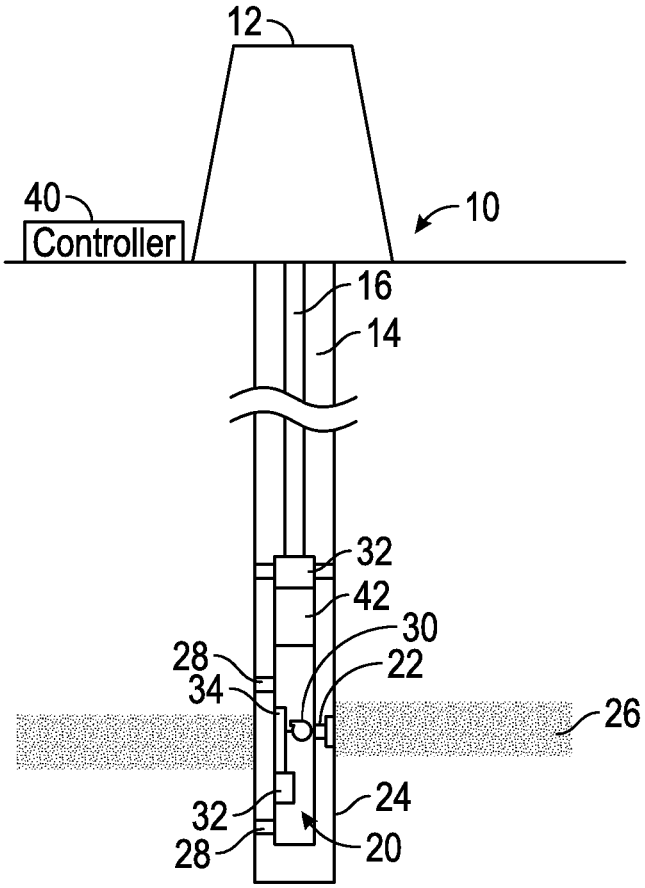
FIG. 1 shows a schematic of a downhole tool deployed in a borehole according to one embodiment of the present disclosure.

FIG. 1 schematically illustrates a borehole system 10 deployed from a rig 12 into a borehole 14. While a land-based rig 12 is shown, it should be understood that the present disclosure may be applicable to offshore rigs and subsea formations. The borehole system 10 may include a carrier 16 and a fluid sampling tool 20. The carrier 16 may be a wireline, jointed drill pipe, coiled tubing, or another conveyance device that can convey the fluid sampling tool 20 along the borehole 14. The fluid sampling tool 20 may include a probe 22 that contacts a borehole wall 24 for extracting formation fluid from a formation 26. Extendable pads or ribs 28 may be used to laterally thrust the probe 22 against the borehole wall 24. The fluid sampling tool 20 may include a pump 30 that pumps formation fluid from formation 26 via the probe 22. Formation fluid travels along a flow line to one or more sample containers 32 or to line 34 from which the formation fluid exits to the borehole 14. A programmable controller may be used to control one or more aspects of the operation of the fluid sampling tool 20. For example, the borehole system 10 may include a surface controller 40 and/or a downhole controller 42.

Figure 2:
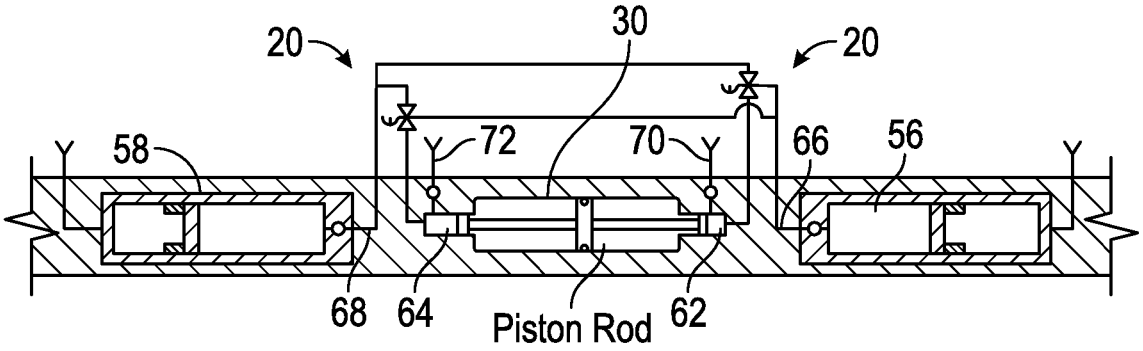
FIG. 2 schematically illustrates a fluid sampling tool according to one embodiment of the present disclosure.

FIG. 2 shows in greater detail a fluid sampling tool 20 in accordance with embodiments of the present disclosure. The fluid sampling tool 20 includes a pump 30 that is configured to pump formation fluid into the well bore during pumping to free the sample of filtrate and to pump formation fluid into sample tanks 56, 58 after sample clean up. One non-limiting fluid pump 30 is bi-directional dual action piston pump. The pump 30 may define a pair of opposed pumping chambers 62 and 64 which are in fluid communication with the respective sample tanks 56, 58 via supply conduits 66 and 68. Discharge from the respective pump chambers 62, 64 is controlled by any suitable control valve arrangement. The respective pumping chambers 62 and 64 are also in fluid communication with the subsurface formation of interest via pump chamber supply passages 70 and 72, which are which are controlled by appropriate valves. The passages 70, 72 may be in fluid communication with the probe 32 (FIG. 1). Other pump types may also be used.

During operation, the pump 30 reduces pressure in conduits 70, 72 to thereby allow formation fluid to flow in the fluid sampling tool 20. As is known, the fluids entering the conduits 70, 72 from the probe 22 (FIG. 1) may be a mixture of two or more fluids. The target fluid is the native fluid residing in the formation, or 'formation fluid.' Often, a secondary fluid is drawn into the probe 32 along with the formation fluid. The formation fluid and the secondary fluid may be immiscible and therefore undergo phase separation.

Figure 3:
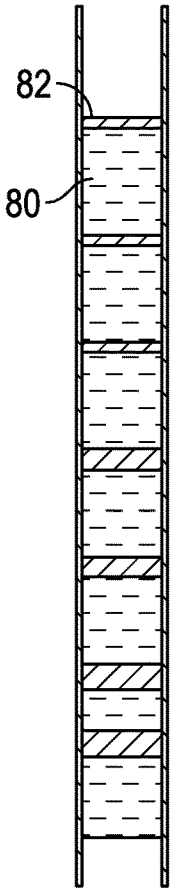
FIG. 3 schematically illustrates a flow line having a sample fluid with separated fluid phases.

Referring now to FIG. 3, there is shown a sample fluid in a line 70 that has separated into two distinct phases: a first fluid 80 and a second fluid 82. The first and second fluids 80, 82 may have different phase states, different chemical phases, and/or different densities. For example, the first fluid 80 may be a naturally occurring hydrocarbon gas or liquid that is native to the formation. The second fluid 82 may be an undesirable natural fluid (e.g., brine, water) or a human engineered fluid that is introduced into the borehole 14 (FIG. 1) from the surface: e.g., oil based drilling mud, a water based drilling mud, injected water. Generally, the presence of the second fluid 82 is undesirable because it can deleteriously interact with the first fluid 80. For example, the second fluid 82 may scavenge one or more substances from the first fluid 80 and/or taint the first fluid 80 with one or more substances. For convenience, the first fluid 80 will be referred to as the "target fluid" and the second fluid 82 will be referred to as the "undesirable fluid." It should be understood that both fluids may themselves be a mixture of fluids.

Referring to FIG. 2, fluid is typically drawn from the formation until the amount of the undesirable fluid has either dropped below a preset level or has stabilized. Such drawn fluid can be ejected out of the tool 20 via the line 34 (FIG. 1). Once the presence of the undesirable fluid has abated to an acceptable level, the sample fluid is directed into the sample tanks 56, 58. As should be appreciated, however, some amount of the undesirable fluid remains in the sample fluid. As will be discussed in greater detail below, embodiments of the present disclosure isolate at least a portion of the undesirable fluid in an isolation volume to prevent undesirable interaction between the target fluid and the undesirable fluid.

Figure 4:
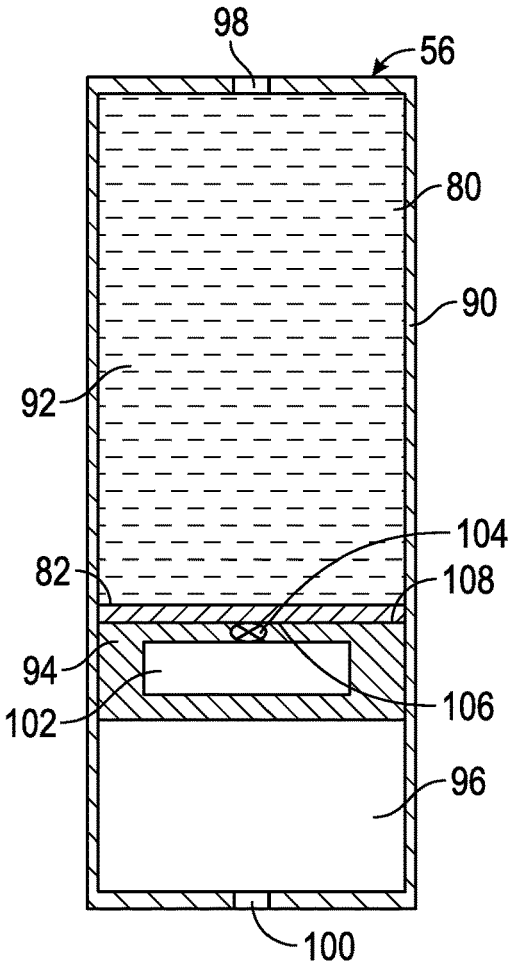
FIG. 4 schematically illustrates one embodiment of a sample tank made according to the present disclosure that uses a chamber as an isolation volume.

Referring now to FIG. 4, there is shown one embodiment of a sample tank 56 according to the present disclosure. The sample tank 56 may be the same as or different form the sample tank 58. In one configuration, the sample tank 56 includes an isolation volume that isolates at least a portion of the undesirable fluid 82 from some or all of the target fluid 80. The sample tank 56 may include an enclosure 90, a main chamber 92, a piston 94, and a pressure chamber 96. An inlet 98 provides selective fluid communication into the main chamber 92 and a passage 100 provides selective fluid communication between the pressure chamber 96 and an exterior of the fluid sampling tool 20.

In one arrangement, the isolation volume may be formed as an isolation chamber 102 disposed in the piston 94 to receive some or substantially all of the undesirable fluid 82 that enters the sample tank 56. A flow control device 104 positioned at an opening 106 between the main chamber 92 and the isolation chamber 102 may be configured to allow the undesirable fluid 82 to enter but not exit the isolation chamber 102. For example, the flow control device 104 may be a one-way check valve.

The FIG. 4 configuration may be suitable for sampling operations wherein the sample tank 56 has a non-horizontal orientation in the borehole 14 (FIG. 1). Specifically, the angle of inclination of the sample tank 56 should be sufficient to allow gravity to pull the relatively more dense second liquid 82 to the valve 104. As shown, the valve 104 and the opening 106 are concentrically positioned in the piston 94. However, the valve 104 and the opening 106 may be sized to draw fluid from a substantial portion of the area of the piston face 108. Moreover, a plurality of valves 104 and openings 106 may be distributed on the piston face 108. Such arrangements may allow the undesirable fluid 82 to enter the isolation chamber 102 even if the undesirable fluid 82 collects along the perimeter of the piston face 108, such as when the sample tank 56 is in a non-vertical orientation.

Referring to FIGS. 2 and 4, in one illustrative operating mode, the pump 30 flows the sample fluid into the main chamber 92. In non-horizontal boreholes, the inclination may be sufficient to allow the lighter target fluid (e.g., gas) to collect at the upper part of the chamber 92 and the denser undesirable fluid (e.g., water) to collect at adjacent to the piston face 108. During this time, the pressure chamber 96 is filled with a borehole fluid that is at ambient borehole pressure. Thus, the pump 30 has to overcome ambient borehole pressure to displace the piston 94, which results in the sample fluid being at ambient borehole pressure, which is at least at the formation pressure. Once the main chamber 92 is full, the pump 30 continues to pressurize the sample fluid. This is sometimes called 'over-pressurizing' the fluid sample because the fluid sample may be stored at a pressure that exceeds the native formation pressure.

During the filling of the chamber 92 and/or during the over-pressurizing, the valve 104 opens to allow the undesirable fluid to enter the isolation chamber 102. The isolation chamber 102 may be configured to receive at least a portion of the undesirable fluid 82 that was initially in the main chamber 92. In one arrangement, the isolation chamber 102 receives a portion of the undesirable fluid 82. In another arrangement, the isolation chamber 102 receives substantially all of the undesirable fluid 82. In still another arrangement, the isolation chamber 102 substantially all of the undesirable fluid and a portion of the target fluid 80. In all these instances, the target fluid 80 in the main chamber is isolated from the undesirable fluid 82 in the isolation chamber 102. This isolation prevents interaction between the target fluid 80 and the isolated undesirable fluid 82. The isolation is not "absolute," but sufficient to limit the target fluid 80 from being altered or degraded chemically, mechanically, or otherwise.

It should be understood that the isolation chamber 102 may be susceptible to numerous variants. For example, instead of a mechanical valve 104, a permeable membrane that blocks passage of the target fluid and allows passage of an undesirable fluid may be used. Moreover, the isolation chamber 102 may be formed within the enclosure 90 or located external to the sample tank 56.

Figure 5:
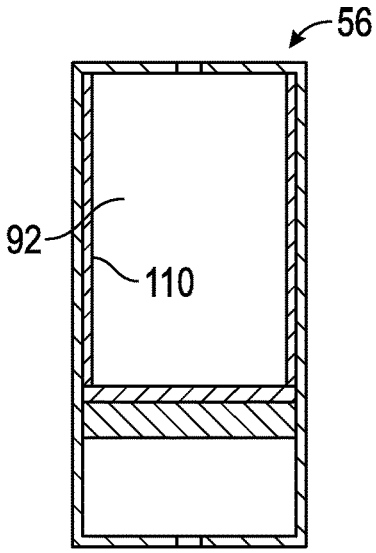
FIG. 5 schematically illustrates an embodiment of a sample tank made according to the present disclosure that uses a binder as an isolation volume.

Referring now to FIG. 5, there is shown another non-limiting embodiment of a sample tank 56 in accordance with the present disclosure that uses a binder as an isolation volume. For example, the sample tank 56 may include a binder 110 within the main chamber 92. The binder 110 may absorb or adsorb the undesirable fluid. As used herein, the term "binder" may be any volume of material that includes surfaces, pores, interstitial spaces, or cavities that can store and retain a selected fluid. Suitable binders include, but are not limited to, polymers. As shown, the binder 110 may line some or all of the interior surfaces defining the main chamber 92. It should be appreciated that such an arrangement allows the binder 110 to interact with the undesirable fluid when the sample tank 56 is in a horizontal orientation as well as a non-horizontal orientation. In certain embodiments, the binder 110 may be positioned in the isolation chamber 102 of FIG. 4.

Figure 6A:
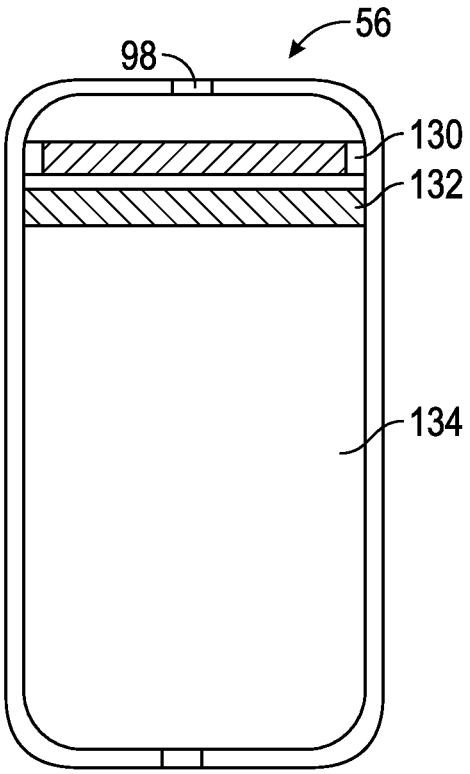
FIGS. 6A-B schematically illustrate an embodiment of a sample tank made according to the present disclosure that uses a membrane to form an isolation volume.
Figure 6B:
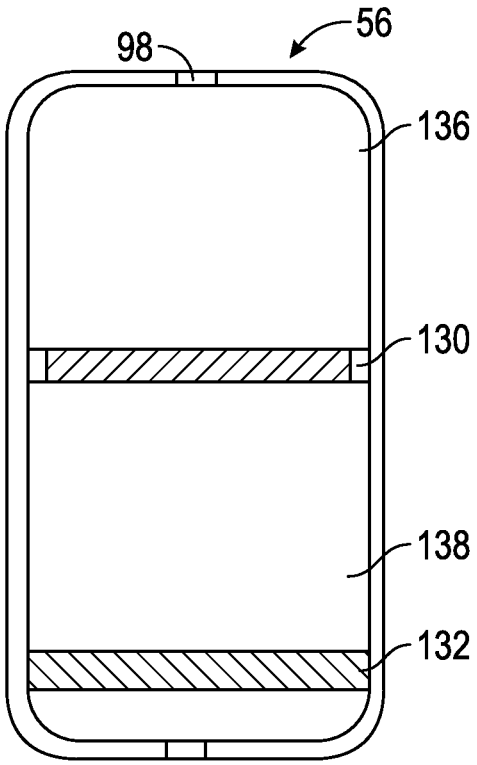

Referring now to FIGS. 6A-B, there is shown a non-limiting embodiment of a sample tank 56 in accordance with the present disclosure that uses a membrane to form an isolation volume for isolating the undesirable fluid. The sample tank 56 may include a semi-permeable piston 130 and an impermeable piston 132 that "float" or axially translate in a chamber 134. The semi-permeable piston 130 allows diffusion of a selected fluid such as gas, but block diffusion of other fluids, such as liquids. The impermeable piston 132 blocks passage of all fluids. Referring to FIG. 6B, the fluid mixture entering via the inlet 98 displaces both of the pistons 130, 132 axially downward. During this displacement, an upper chamber 136 is formed between the inlet 98 and the semi-permeable piston 130 and a lower chamber 138 is formed between the semi-permeable piston 130 and the impermeable piston 132. The semi-permeable piston 130 allows the gas in the fluid mixture to diffuse into the lower chamber 138 while isolating the undesirable fluids, such as water, in the upper chamber 136. The upper chamber 136 may act as the isolation volume that isolates the undesirable fluid and the lower chamber 138 may act as the "main chamber" that stores the target fluid. It should be noted that the pressure in the upper chamber 136 is higher than the pressure in the lower chamber 138 in order to induce the gas diffusion through the semi-permeable piston 130. This pressure differential may be generated during pumping of the fluid sample into the sample tank 56 and/or during over-pressurizing the fluid sample in the sample tank 56. In some embodiments, the semi-permeable piston 130 may be prevented from traveling the full axial length of the sample tank 56. That is, a shoulder or stop (not shown) may be used to limit the travel of the semi-permeable piston 130 and thereby define a maximum volume of the upper chamber 136.

Figure 6C:
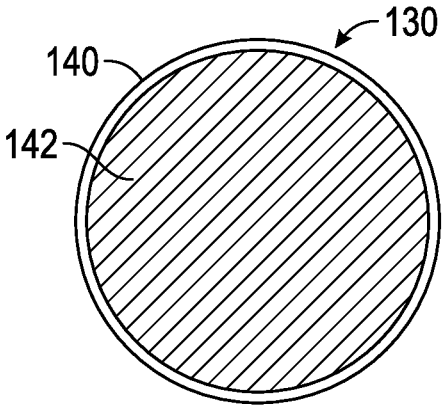
FIG. 6C schematically illustrates an embodiment of a membrane used in the FIGS. 6A-B embodiment.

Referring now to FIG. 6C, there is shown one embodiment of the semi-permeable piston 130. The semi-permeable piston 130 may include a support ring 140 and a membrane 142. The support ring 140 may include suitable sealing elements (not shown) that form a gas-tight seal against the tank 56 (FIG. 4). The membrane may be formed as a molecular sieve constructed in the form of a film from two or more layered materials. Illustrative materials for membranes include, but are not limited to, a TFC material, polyamides, cation exchange membranes, charge mosaic membranes, bipolar membranes, proton exchange membranes, hydrophobic materials, etc. Referring to FIGS. 4 and 6C, in some embodiments, the pressure in the upper chamber 136 is held higher than the pressure in the lower chamber 138 to keep the gas in the lower chamber 138. In other embodiments, the membrane 142 may be structured to permit only uni-directional diffusion. Thus, gas may be effectively sealed in the lower chamber 138 even if the pressure in the upper chamber 136 eventually drops below the pressure in the lower chamber 138.

As used above, the term horizontal refers to an axis or plane transverse to gravitational north and vertical refers to an axis or plane parallel to gravitation north.

While the foregoing disclosure is directed to the one mode embodiments of the disclosure, various modifications will be apparent to those skilled in the art. It is intended that all variations be embraced by the foregoing disclosure.

We claim:

1. A method for obtaining a fluid sample downhole, comprising:

retrieving the fluid sample downhole, the fluid sample including at least a target fluid and an undesirable fluid;

receiving the fluid sample into a sample tank positioned in a borehole, the sample tank having a main chamber and an isolation chamber;

separating the target fluid and the undesirable fluid while receiving the fluid sample into the sample tank by using a physical barrier to prevent interaction between the undesirable fluid in the isolation chamber and the target fluid in the main chamber while the undesirable fluid and the target fluid are in the sample tank, wherein the physical barrier is disposed between and separates the main chamber from the isolation chamber;

storing the undesirable fluid in the isolation chamber after the target fluid and the undesirable fluid are separated; and storing the target fluid in the main chamber after the target fluid and the undesirable fluid are separated by the physical barrier in the sample tank.

2. The method of claim 1, wherein the target fluid and the undesirable fluid are immiscible.

3. The method of claim 1, wherein the target fluid is a gas and the undesirable fluid is one of (i) a liquid hydrocarbon, (ii) water, and (iii) an engineered fluid.

4. The method of claim 1, wherein the target fluid is a liquid and the undesirable fluid is one of (i) water, and (ii) an engineered fluid.

5. The method of claim 1, wherein the target fluid and the undesirable fluid are chemically dissimilar.

6. The method of claim 1, wherein the target fluid is a formation fluid and the undesirable fluid is a fluid pumped into the borehole from a surface location.

7. The method of claim 1, wherein a first portion of the physical barrier defines the main chamber and a second portion of the physical barrier defines the isolation chamber, wherein the main chamber and the isolation chamber are formed inside an enclosure of the sample tank; and further comprising preventing the undesirable fluid from flowing out of the isolation chamber.

8. An apparatus for obtaining a fluid sample downhole, the fluid sample including at least a target fluid and an undesirable fluid, comprising:

a conveyance device configured to be conveyed along a borehole; and a fluid sampling tool positioned along the conveyance device, the conveyance device including:

a probe receiving the fluid sample from a formation;

a pump drawing the fluid sample through the probe; and at least one sample tank receiving the fluid sample from the pump, wherein the at least one sample tank includes a physical barrier that forms a main chamber and an isolation chamber inside the at least one sample tank, the physical barrier being disposed between and separating the main chamber from the isolation chamber, the main chamber having an inlet receiving the fluid sample from the pump, the physical barrier having at least one opening pass the undesirable fluid from the main chamber to the isolation chamber, wherein the main chamber receives the fluid sample and the isolation chamber isolates at least a portion of the undesirable fluid from the target fluid in the main chamber, the isolation chamber being configured to store the undesirable fluid in the sample tank and prevent interaction between the undesirable fluid and the target fluid, wherein the sample tank includes an inlet, and wherein the physical barrier includes a semi-permeable piston and an impermeable piston disposed in the at least one sample tank, wherein an upper chamber is defined between the inlet and the semi-permeable piston and a lower chamber is defined between the semi-permeable piston and the non-permeable piston, wherein the upper chamber defines the isolation chamber and the lower chamber defines the main chamber.

9. An apparatus for obtaining a fluid sample downhole, the fluid sample including at least a target fluid and an undesirable fluid, comprising:

a conveyance device configured to be conveyed along a borehole; and a fluid sampling tool positioned along the conveyance device, the conveyance device including:

a probe receiving the fluid sample from a formation;

a pump drawing the fluid sample through the probe; and at least one sample tank receiving the fluid sample from the pump, wherein the at least one sample tank includes a physical barrier that forms a main chamber and an isolation chamber inside the at least one sample tank, the physical barrier being disposed between and separating the main chamber from the isolation chamber, the main chamber having an inlet receiving the fluid sample from the pump, the physical barrier having at least one opening pass the undesirable fluid from the main chamber to the isolation chamber, wherein the main chamber receives the fluid sample and the isolation chamber isolates at least a portion of the undesirable fluid from the target fluid in the main chamber, the isolation chamber being configured to store the undesirable fluid in the sample tank and prevent interaction between the undesirable fluid and the target fluid, wherein the isolation chamber includes a binder material configured to interact with and retain the undesirable fluid.

* * * * *